US006053147A

United States Patent [19]

Hemmerlein et al.

[11] Patent Number: 6,053,147

[45] Date of Patent: Apr. 25, 2000

[54] APPARATUS AND METHOD FOR DIAGNOSING ERRATIC PRESSURE SENSOR OPERATION IN A FUEL SYSTEM OF AN INTERNAL COMBUSTION ENGINE

[75] Inventors: Rodney J. Hemmerlein, Columbus; Stephen West, Greenwood, both of Ind.

[73] Assignee: Cummins Engine Company, Inc., Columbus, Ind.

[21] Appl. No.: 09/033,378

[22] Filed: Mar. 2, 1998

[51] Int. Cl.[7] ..... F02M 7/00; F02B 77/00

[52] U.S. Cl. ..... 123/447; 123/198 D

[58] Field of Search ..... 123/447, 494, 123/198 D, 456, 479, 497; 73/119 A

[56] References Cited

U.S. PATENT DOCUMENTS

| | | | |
|---|---|---|---|
| 4,920,494 | 4/1990 | Abo et al. . | |
| 5,349,933 | 9/1994 | Hasegawa et al. . | |
| 5,448,977 | 9/1995 | Smith et al. . | |
| 5,492,099 | 2/1996 | Maddock | 123/198 D |
| 5,495,841 | 3/1996 | Gillbrand et al. . | |
| 5,499,538 | 3/1996 | Glidewell et al. . | |
| 5,526,794 | 6/1996 | Messih et al. . | |
| 5,619,969 | 4/1997 | Liu | 123/447 |
| 5,642,722 | 7/1997 | Schumacher et al. . | |
| 5,677,480 | 10/1997 | Liyanage et al. . | |
| 5,678,521 | 10/1997 | Thompson | 123/447 |
| 5,685,268 | 11/1997 | Wakemen . | |
| 5,689,066 | 11/1997 | Stevenson . | |
| 5,699,254 | 12/1997 | Abate et al. . | |
| 5,711,273 | 1/1998 | Barnes | 123/198 D |
| 5,715,786 | 2/1998 | Seiberth | 123/198 D |
| 5,727,516 | 3/1998 | Augustin | 123/447 |
| 5,727,525 | 3/1998 | Tsuzuki | 123/447 |
| 5,732,675 | 3/1998 | Yoshida | 123/494 |
| 5,732,679 | 3/1998 | Takahasi | 123/447 |
| 5,806,497 | 9/1998 | Hosoya | 123/494 |

*Primary Examiner*—Carl S. Miller
*Attorney, Agent, or Firm*—Beck, Michael & Beck, P.C.

[57] ABSTRACT

A fuel system includes a pair of electronically controllable high pressure fuel pumps operable to supply high pressure fuel from a lower pressure fuel source to a high pressure fuel accumulator having a pressure sensor associated therewith. The fuel collection chamber feeds an electronically controllable valve operable to dispense the high pressure fuel to a fuel distribution unit supplying fuel to a number of fuel injectors. A control computer is provided for controlling the high pressure fuel pump and valve in response to requested fueling, engine speed and fuel pressure provided by the pressure sensor. The accumulator pressure signal is processed in accordance with the present invention for diagnosing erratic pressure sensor failures. The control computer is operable to compute error pressure values based on differences between peak accumulator pressure values and a target pressure value, and compute pressure error variance values based on subsets of the pressure error values. A fault code is logged and a limp home fueling algorithm is executed if a predefined number of variance values exceed a variance threshold.

22 Claims, 11 Drawing Sheets

NORMAL PUMPING/INJECTION EVENTS
ICV COMMANDS
CYLINDER TDC POSITION
CRANK ANGLE (°)
FRONT CAM
FRONT PUMP COMMANDS
REAR CAM
REAR PUMP COMMANDS 2
4
1
5
3
6
-240
-180
-120
-60
0
60
120
180
240
300
360
420
A
B
C
D
E
F

APPARATUS AND METHOD FOR DIAGNOSING ERRATIC PRESSURE SENSOR OPERATION IN A FUEL SYSTEM OF AN INTERNAL COMBUSTION ENGINE

FIELD OF THE INVENTION

The present invention relates generally to fuel system control techniques, and more specifically to techniques for diagnosing failures and fault conditions in a fuel system.

BACKGROUND OF THE INVENTION

Electronically controlled high pressure fuel systems are known and commonly used in the automotive and heavy duty truck industries. Such systems may include a fuel pump operable to provide high pressure fuel to a collection unit that supplies the pressurized fuel to one or more fuel injectors. One or more pressure sensors are typically provided for monitoring and controlling the fuel pressure throughout the system.

An example of one such system is described in U.S. Pat. No. 5,678,521 to Thompson et al., which is assigned to the assignee of the present invention. The Thompson et al. fuel system includes a pair of cam driven high pressure fuel pumps operable to pump fuel from a low pressure fuel source to an accumulator. The accumulator passes the high pressure fuel to a single injection control valve which is electronically controllable to supply the fuel to a distributor unit. The distributor, in turn, distributes the fuel to any of a number of fuel injectors. The accumulator includes a pressure sensor for monitoring accumulator pressure. An electronic control unit monitors accumulator pressure, throttle position and engine speed, and is operable to control the operation of the fuel system in accordance therewith.

High pressure fuel systems of the type just described, while having many advantages over prior mechanical systems, have certain drawbacks associated therewith. For example, failure of electrical and/or mechanical components of the system may result in total system failure, in which case the engine is often shut down leaving the vehicle and occupant stranded. In severe cases, failure of such components can lead to catastrophic destruction of fuel system components.

What is therefore needed is a system for diagnosing faults and failures in an electronically controlled fuel system of the type just described. Such a system should ideally log fault codes indicative of fuel system related failures, and pressure sensor failures in particular, to assist in repair efforts, and should additionally provide for a limp home fueling operational mode so that the vehicle can be driven out of danger and/or to a repair facility.

SUMMARY OF THE INVENTION

The foregoing shortcomings of the prior art are addressed by the present invention. In accordance with one aspect of the present invention, apparatus for diagnosing a fuel system of an internal combustion engine comprises an accumulator receiving pressurized fuel from a source of pressurized fuel, means for sensing fuel pressure within the accumulator and producing a pressure signal corresponding thereto, the pressure signal having peak values corresponding to peak pressures of fuel supplied thereto by the source of pressurized fuel, and a control computer sampling a number of first pressure values each near a separate one of the peak values and determining a number of pressure error values each between a separate one of the number of first pressure values and a corresponding reference pressure, the control computer determining a variance of at least some of the number of pressure error values and incrementing an error counter if the variance exceeds a variance threshold.

In accordance with another aspect of the present invention, a method of diagnosing a fuel system of an internal combustion engine comprises the steps of supplying fuel from a source of pressurized fuel to an accumulator based on a target fuel pressure value, measuring a number of peak pressure values within the accumulator each near corresponding actual peak pressures therein resulting from the supplying step, determining a number of error pressure values each between a separate one of the peak pressure values and the target fuel pressure value, determining a variance of at least some of the number of error pressure values, and incrementing an error counter if the variance exceeds a variance threshold.

In accordance with either of the foregoing aspects, the error counter is decremented, preferably not below a predefined count value, if the variance is less than the variance threshold. If the error counter exceeds a predefined count value, a fault code is logged and a limp home fueling algorithm is preferably executed.

One object of the present invention is to provide an apparatus and method for diagnosing erratic pressure sensor related failures in an electronically controlled fuel system of an internal combustion engine.

Another object of the present invention is to provide such an apparatus and method that logs a fault code and executed a limp home fueling algorithm upon detection of erratic pressure sensor behavior.

These and other objects of the present invention will become more apparent from the following description of the preferred embodiment.

DESCRIPTION OF THE PREFERRED EMBODIMENT

Figure 1:
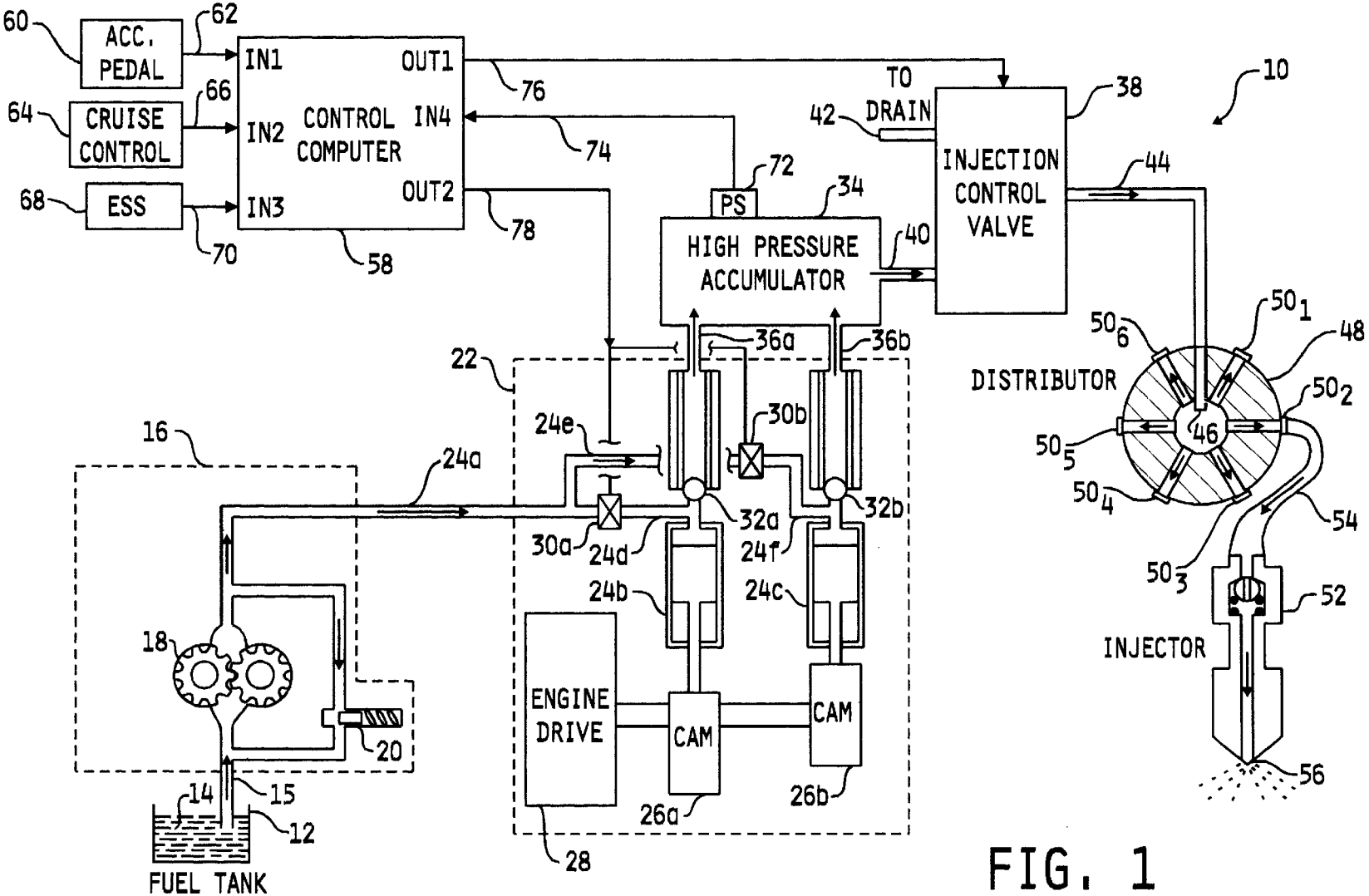
FIG. 1 is a diagrammatic illustration of a fuel system for an internal combustion engine and associated control system, in accordance with the present invention.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

Referring now to FIG. 1, a fuel system and associated control system 10, in accordance with the present invention, is shown. System 10 includes a fuel tank 12 or similar source of fuel 14 having a fuel flow path 15 extending into a low pressure fuel pump 16. Preferably, low pressure pump 16 is a known gear pump having a manually gear mechanism 18 and fuel pressure regulator 20. A fuel flow conduit 24*a* extends into a high pressure fuel pump 22 having a first (front) pump element 24*b* and a second (rear) pump element 24*c*. Pump elements 24*b* and 24*c* are mechanically driven by an engine drive mechanism 28 via cams 26*a* and 26*b* respectively. Fuel flow conduit 24*a* feeds a first pump control valve 30*a* having an output fuel flow conduit 24*d* connected to pump element 24*b*. Fuel flow conduit 24*a* is also connected to a fuel flow conduit 24*e* which feeds a second pump control valve 30*b* having an output fuel flow conduit 24*f* connected to pump element 24*c*. The first pump element 24*b* is connected to a high pressure fuel accumulator 34 via conduit 36*a* with a check valve 32*a* disposed therebetween. Likewise, the second pump element 24*c* is connected to accumulator 34 via conduit 36*b* with a check valve 32*b* disposed therebetween.

High pressure accumulator 34 is connected to an injection control valve 38 via conduit 40. Injection control valve 38 includes a drain conduit 42 and an output conduit 44 feeding an input 46 of a fuel distributor 48. Distributor 48 includes a number of output ports, wherein six such output ports $\mathbf{50}_1$–$\mathbf{50}_6$ are illustrated in FIG. 1. It is to be understood, however, that distributor 48 may include any number of output ports for distributing fuel to a number of fuel injectors or groups of fuel injectors. In FIG. 1, one such fuel injector 52 is connected to output port $\mathbf{50}_2$ via fuel flow path 54, wherein injector 52 has an injector output 56 for ejecting fuel into an engine cylinder.

System 10 is electronically controlled by a control computer 58 in response to a number of sensor and engine/vehicle operating conditions. An accelerator pedal 60 preferably includes an accelerator pedal position sensor (not shown) providing a signal indicative of accelerator pedal position or percentage to input IN1 of control computer 58 via signal path 62, although the present invention contemplates utilizing any known sensing mechanism to provide control computer 58 with a fuel demand signal from accelerator pedal 60. A known cruise control unit 64 provides a fuel demand signal to input IN2 of control computer 58 via signal path 66 indicative of desired vehicle speed when cruise control operation is selected as is known in the art.

An engine speed sensor 68 is connected to an input IN3 of control computer 58 via signal path 70, providing control computer 58 with a signal indicative of engine speed position. In one embodiment, engine speed sensor 68 is a known HALL effect sensor, although the present invention contemplates using any known sensor operable to sense engine speed and preferably engine position, such as a variable reluctance sensor. High pressure accumulator 34 includes a pressure sensor 72 connected thereto which is operable to sense pressure within the accumulator 34. Pressure sensor 72 provides a pressure signal indicative of accumulator pressure to input IN4 of control computer 58 via signal path 74. Preferably, pressure sensor 72 is a known pressure sensor, although the present invention contemplates utilizing any known device, mechanism or technique for providing control computer 58 with a signal indicative of fuel pressure within accumulator 34, conduit 36*a*, conduit 36*b* or conduit 40. Control computer 58 also includes a first output OUT1 connected to injection control valve 38 via signal path 76 and a second output 78 connected to pump control valves 30*a* and 30*b* via signal path 78. The general operation of fuel system 10 and associated control system will be described with reference to FIGS. 1–4.

Figure 2:
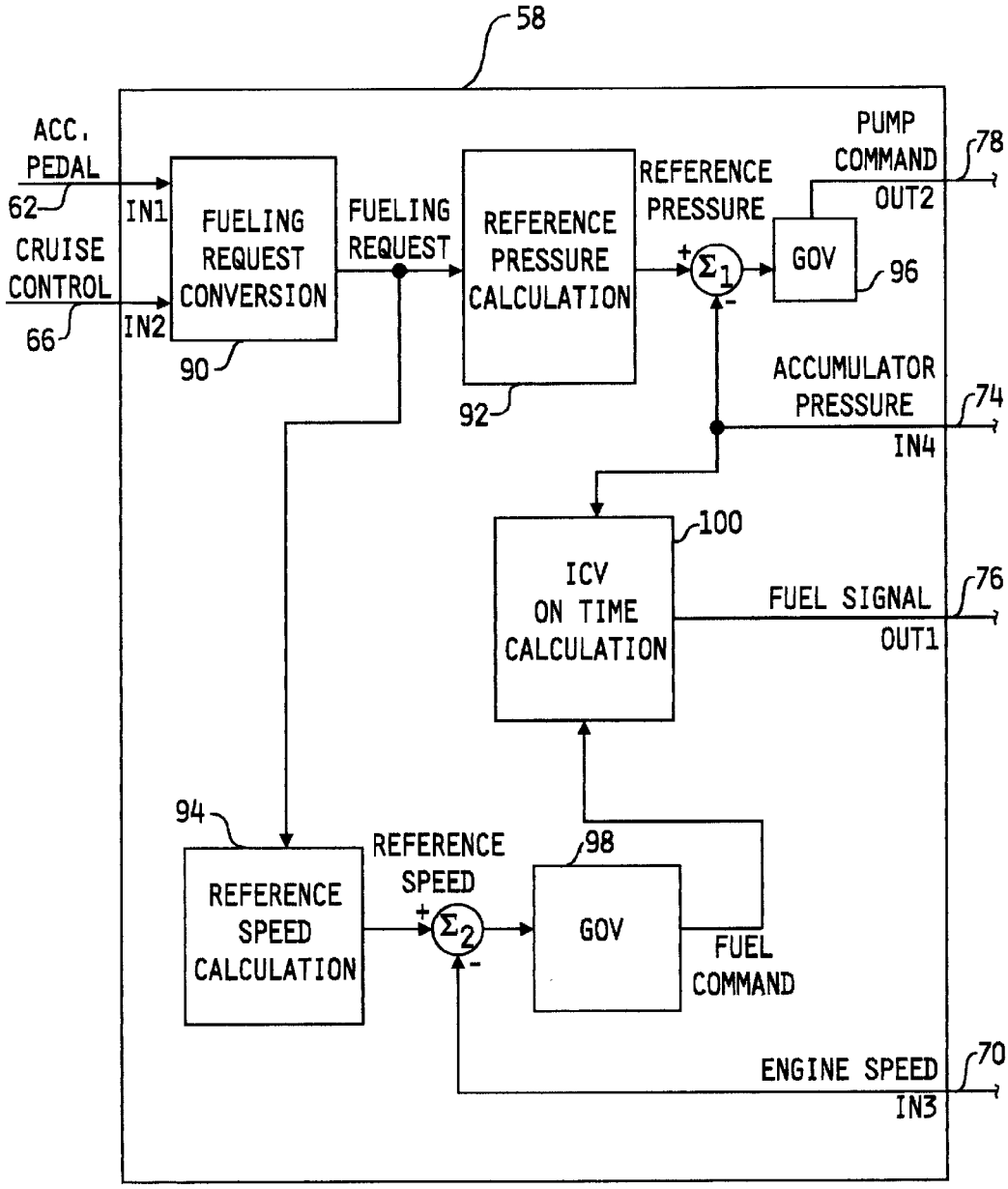
FIG. 2 is a block diagram illustration of some of the internal features of the control computer of FIG. 1 under normal operation thereof, as they relate to the present invention.

Referring to FIGS. 1 and 2, some of the internal features of control computer 58, as they relate to the present invention, are illustrated. The accelerator pedal signal and cruise control signal enter control computer 58 via signal paths 62 and 66 respectively. As is known in the art, both signals are operator originated in accordance with desired fueling, and control computer 58 is responsive to either signal to correspondingly control the fuel system 10. Hereinafter, the accelerator pedal and/or cruise control signal will be referred to generically as a fuel demand signal. In any case, the fuel demand signal is provided to a fueling request conversion block 90 which converts the fuel demand signal to a fueling request signal in accordance with known techniques. Typically, fueling request conversion block 90 includes a number of fuel maps and is responsive to a number of engine/vehicle operating conditions, in addition to the fuel demand signal, to determine an appropriate fueling request value.

The fueling request value is provided to a reference pressure calculation block 92 which is responsive to the fueling request value to determine a reference pressure indicative of a desired accumulator pressure set point. The reference pressure is provided to an accumulator pressure control loop which provides a pump command signal on signal path 78 based on the reference pressure value and accumulator pressure provided by pressure sensor 72 on signal path 74. In one embodiment, the reference pressure value is provided to a positive input of a summing node $\Sigma_1$ which also has a negative input connected to signal path 74. An output of summing node $\Sigma_1$ is provided to a governor block 96, the output of which is connected to signal path 78.

In one embodiment, governor block 96 includes a known PID governor, although the present invention contemplates utilizing other known governors or governor techniques.

The fueling request value is also provided to a reference speed calculation block 94 which is responsive to the fueling request value to determine a reference speed indicative of a desired engine speed. The reference speed is provided to an engine speed control loop which produces a fuel command value in accordance therewith, as is known in the art, based on the reference speed and actual engine speed provided by engine speed sensor 68 on signal path 70. In one embodiment, the reference speed value is provided to a positive input of a summing node $\Sigma_2$ which also has a negative input connected to signal path 70. An output of summing node $\Sigma_2$ is provided to a governor block 98, the output of which provides the fuel command value. In one embodiment, governor block 98 includes a known PID governor, although the present invention contemplates utilizing other known governors or governor techniques.

Control computer 58 also includes an ICV on time calculation block 100 which is operable to determine an "on time" for activating the injection control valve (ICV) 38 based on the actual accumulator pressure signal provided on signal path 74 and the fuel command provided by governor 98. The ICV on time calculation block 100 produces a fuel signal on signal path 76 for controlling activation/deactivation of the injector control valve 38.

Figures 3A, 3B, 3C, 3D, 3E, 3F, 3G:
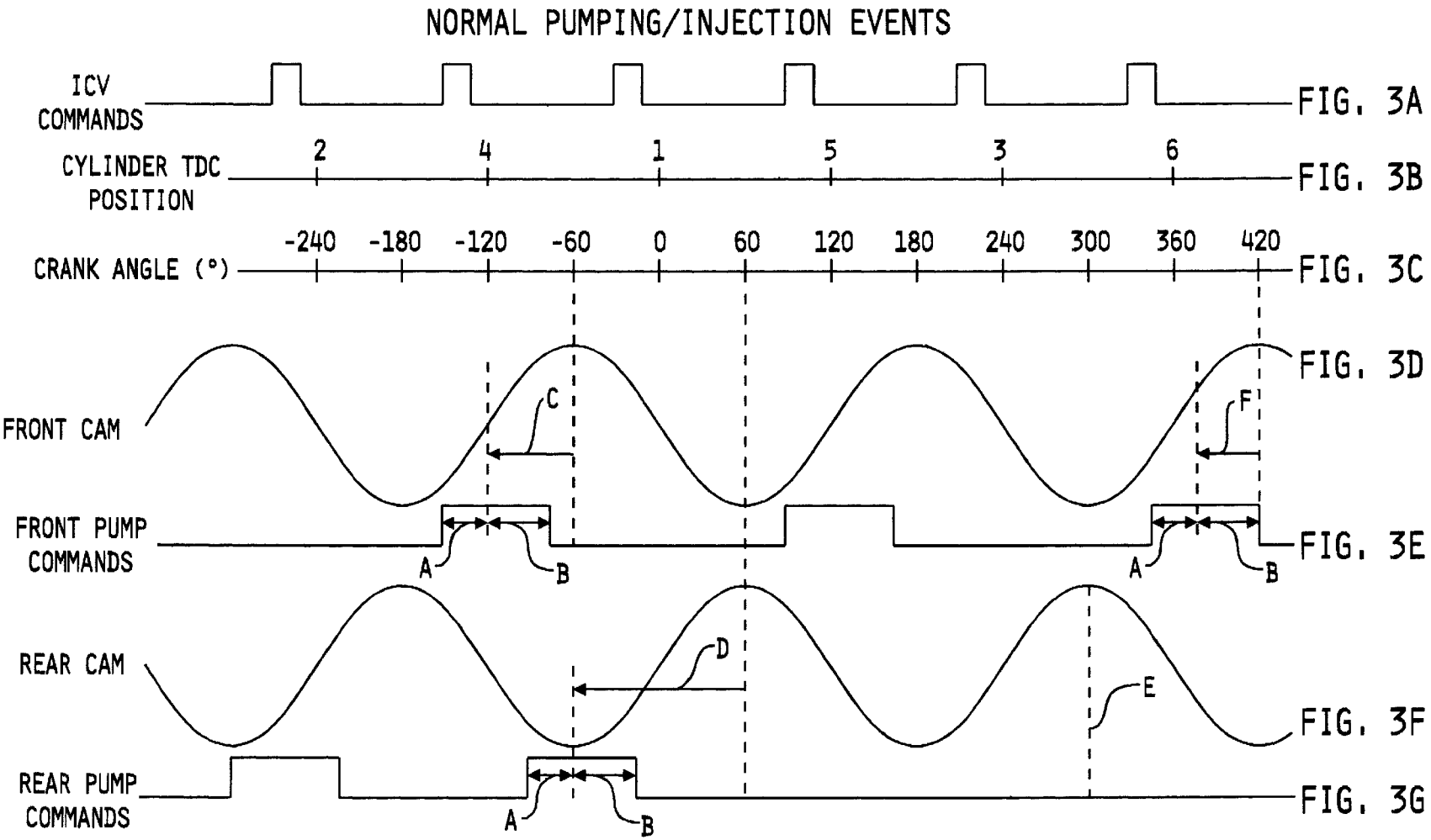
FIG. 3 is composed of FIGS. 3A–3G and illustrates waveform diagrams of normal operation of the fuel system and associated control system of FIG. 1.

Referring now to FIG. 3, which is composed of FIGS. 3A–3G, some of the general timing events of fuel system 10 are illustrated. Control computer 58 is operable to control fuel pressure within the accumulator 34 by controlling the pump control valves 24*b* and 24*c*. Control of one of the valves 24*b* will now be described, although it is to be understood that operation thereof applies identically to valve 24*c*. As the pump plunger retract within the pump element 24*b* under the action of cam 26*a*, fuel supplied by low pressure fuel pump 16 flows into the trapped volume of fuel pump element 24*b* as long as valve 30*a* is not energized. If valve 30*a* remains de-energized as the pump plunger rises, fuel within the trapped volume flows back out to low pressure fuel pump 16. When the pump control valve 30*a* is energized, the outward fuel flow path is closed and the fuel within the trapped volume of pump element 24*b* becomes pressurizes as the pump plunger rises. When the fuel pressure within the trapped volume reaches a specified pressure level, check valve 32*a* opens and the pressurized fuel within the trapped volume flows into the accumulator. Based upon a difference between the reference pressure (block 92 of FIG. 2) and the actual accumulator pressure (provided on signal path 74), the pressure control loop of FIG. 2 specifies the angle before pump plunger top dead center (TDC) at which the pump control valve 30*a* is energized. This angle will be referred to hereinafter as a valve close angle (VCA).

In one embodiment of fuel system 10, as illustrated in FIGS. 3B–3G, pump plunger TDC (shown in FIGS. 3D and 3F as front and rear cam respectively) and cylinder TDC (FIG. 3B) are aligned 60 crank degrees apart (FIG. 3C). The commanded VCA (pump command) may occur anywhere between zero and 120 degrees before pump plunger TDC (see FIGS. 3D–3G). When the difference between the reference pressure and actual accumulator pressure is large, the respective commanded VCA is large and vice versa. Examples of different commanded VCA's are illustrated in FIGS. 3E and 3G wherein pump command activation times are shown as having a pump activation delay time A and a pump activation time B. VCA's corresponding to 65 degrees and 30 degrees are shown in FIG. 3E by C and F respectively, and a VCA of 120 degrees is shown in FIG. 3G by D. If the actual accumulator pressure is greater than the reference pressure, the commanded VCA is automatically set at zero degrees, corresponding to no energization of the pump control valve 30*a*, as illustrated at E in FIG. 3G. Control computer 58 is further operable to activate the injection control valve 38 (to control fuel timing) and deactivate valve 38 (to control fueling amount) between pump plunger TDC and cylinder TDC as illustrated in FIGS. 3A, 3B, 3D and 3F. Further operational and structural details of fuel system 10 and associated control system are given in U.S. Pat. No. 5,678,521 to Thompson et al., which is assigned to the assignee of the present invention, the contents of which are incorporated herein by reference.

Figure 4:
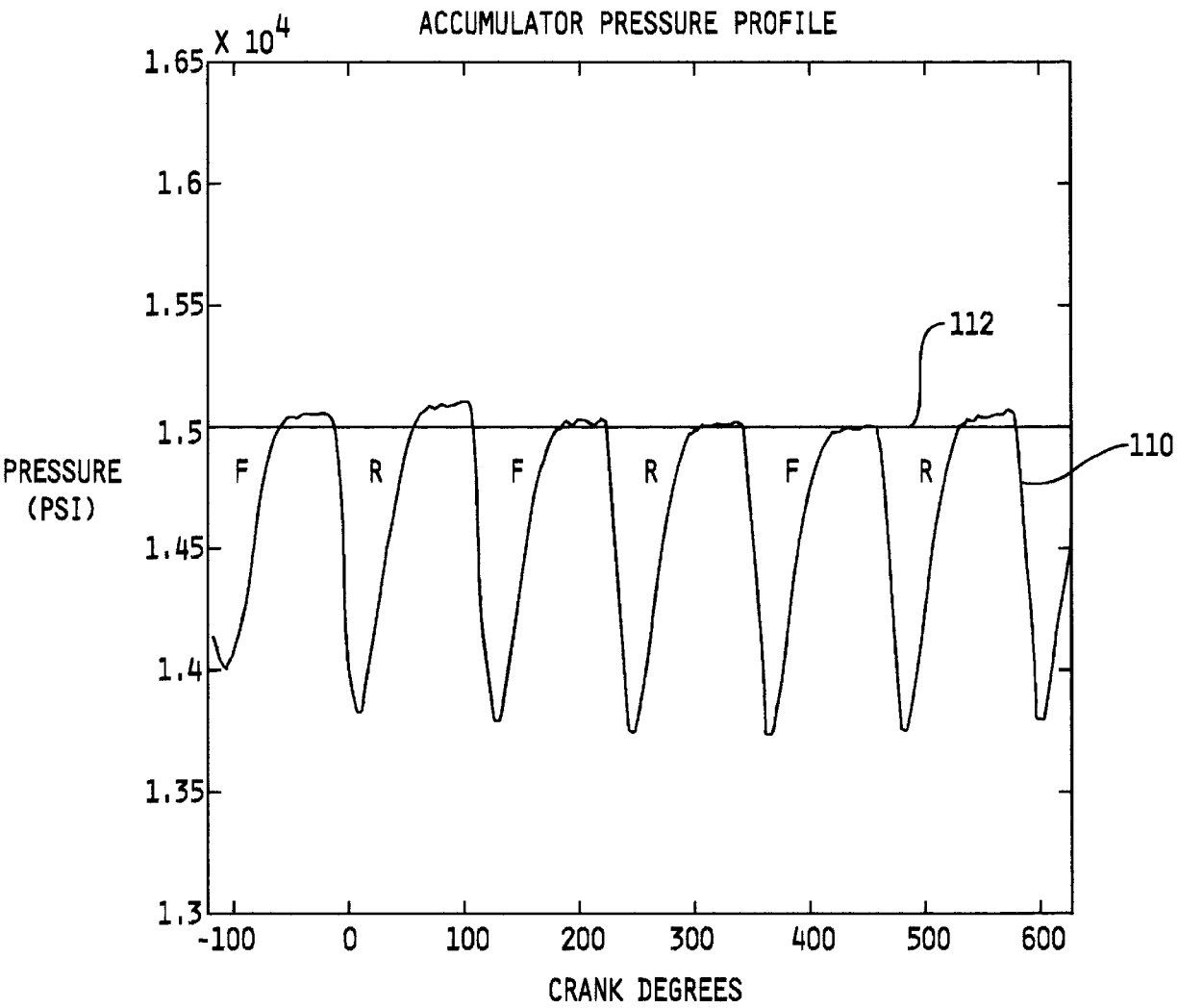
FIG. 4 is a plot of pressure vs. crank angle of a normal pressure waveform associated with the accumulator of in FIG. 1 .

As fuel enters the accumulator 34, accumulator pressure begins to rise and reaches the reference pressure (FIG. 2) approximately 30 degrees after pump plunger TDC. Thirty degrees after pump plunger TDC of each pumping event, control computer 58 samples accumulator pressure and maintains such samples as peak accumulator pressure samples. Approximately 45–75 degrees after pump plunger TDC, control computer 58 activates the injection control valve 38 (FIG. 3A) to begin an injection event. As fuel is drawn out of the accumulator 38 resulting from activation of the injection control valve 38, the pressure in the accumulator decreases, and approximately 80 degrees after pump plunger TDC accumulator pressure reaches a minimum. Control computer 58 again samples accumulator pressure at 80 degrees after pump plunger TDC and maintains such samples valley accumulator pressure samples. A plot of accumulator pressure 110 vs. crank degrees, as contrasted with reference pressure 112, is illustrated in FIG. 4. FIG. 4 illustrates an accumulator pressure profile for one complete cam revolution of a six cylinder engine. As shown by waveform 110, the front (24*b*) and rear (24*c*) pump elements alternate operation, and control computer 58 samples six peak pressure values and six valley pressure values each cam revolution.

In accordance the present invention, control computer 58 is operable to monitor the accumulator pressure waveform, an example of which is illustrated in FIG. 4, and diagnose various fuel system related faults and failure conditions; particularly faults and failures associated with the operation of the pressure sensor 72. One example of such a fuel system fault or failure condition is a stuck in-range failure of pressure sensor 72, the details of which are described in co-pending U.S. patent application Ser. No. 09/033,379 filed by Stavnheim et al., entitled APPARATUS FOR DIAGNOSING FAILURES AND FAULT CONDITIONS IN A FUEL SYSTEM OF AN INTERNAL COMBUSTION ENGINE and assigned to the assignee of the present invention, the contents of which are incorporated herein by reference. However, the Stavnheim et al. application, as it relates to the detection of pressure sensor related failures, is concerned mainly with stuck in range pressure sensor failures and is therefore not operable to detect intermittent or erratic pressure sensor failures. The present invention is directed to diagnosing such intermittent or erratic pressure sensor failures by monitoring accumulator pressure, and computing a variance in a difference between the sensed accumulator pressure and reference pressure (or pressure setpoint). If the variance between the sensed accumulator pressure and pressure setpoint exceeds a predefined variance threshold for a calibratable number of variance values, computer 58 is operable to log a fault code therein and execute a limp home fueling algorithm directed at pressure sensor-related failures. An example of one particular limp home fueling algorithm useful with the present invention is described in co-pending U.S. patent application Ser. No. 09/033,338 filed by Olson et al., entitled APPARATUS FOR CONTROLLING A FUEL SYSTEM OF AN INTERNAL COMBUSTION ENGINE and assigned to the assignee of the present invention, the contents of which are incorporated herein by reference.

Figure 5:
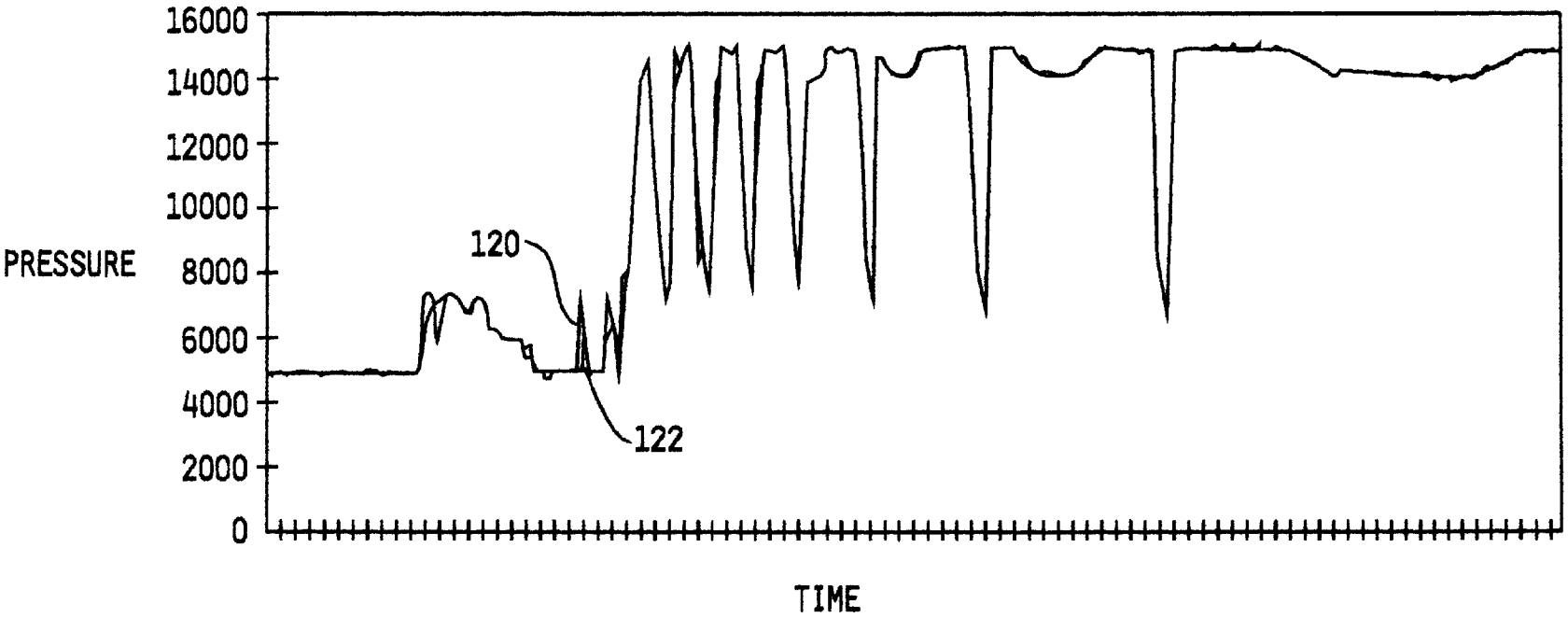
FIG. 5 is a plot of pressure vs. time of a normal pressure waveform and a target pressure waveform associated with the accumulator of FIG. 1.

Referring now to FIG. 5, a plot of accumulator pressure 122 over time, preferably provided to input IN4 of control computer 58 via pressure sensor 72, is shown compared to a reference pressure (accumulator pressure setpoint) waveform 120, preferably provided by the reference pressure calculation block 92 of FIG. 2. Waveforms 120 and 122 are indicative of a normally operating fuel system 10, and it should be observed that actual accumulator pressure 122 tracks the reference pressure 120 fairly closely. Although the exact values of the set point waveform 120 and the measured pressure waveform 122 may be somewhat different at any given instant in time, the variability or rates at which they each change are very similar.

Figure 6:
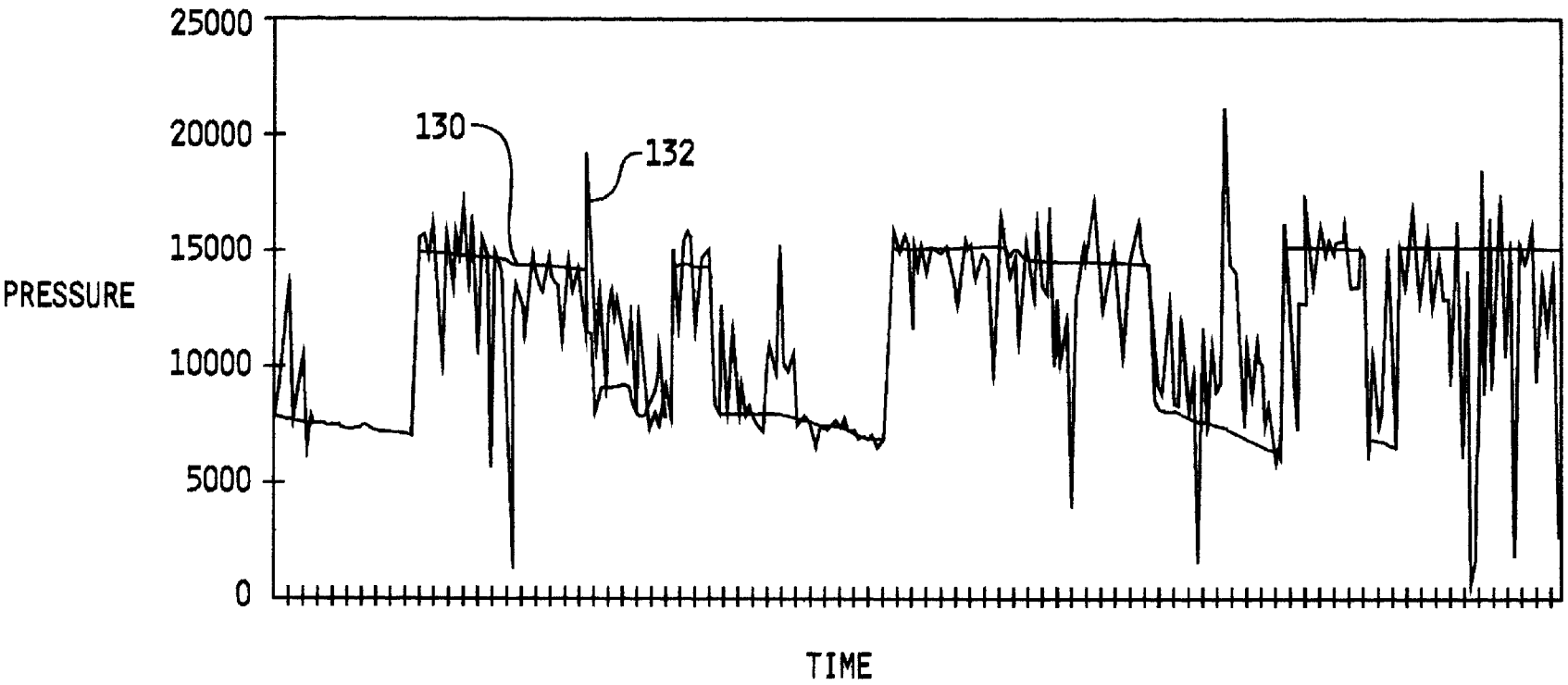
FIG. 6 is a plot of pressure vs. time of an accumulator pressure waveform sensed by an erratic pressure sensor as compared with a target pressure waveform.

Referring now to FIG. 6, by contrast, a reference pressure waveform 130 is shown compared with an accumulator pressure waveform 132 indicative of a pressure sensor 72 exhibiting erratic operation. Erratic pressure sensor behavior is characterized by random and unpredictable transients which are independent of the pressure setpoint waveform 130. The random and varying pressure measurements contribute higher frequency components to the measured pressure signal 132. As seen in FIG. 6, it is the higher frequency components that distinguish waveform 132 from waveform 130, thereby indicating erratic pressure sensor operation. In accordance with the present invention, control computer 58 is accordingly operable to measure and compare the variability of the pressure setpoint waveform with the variability of the measured accumulator pressure waveform.

Figure 11:
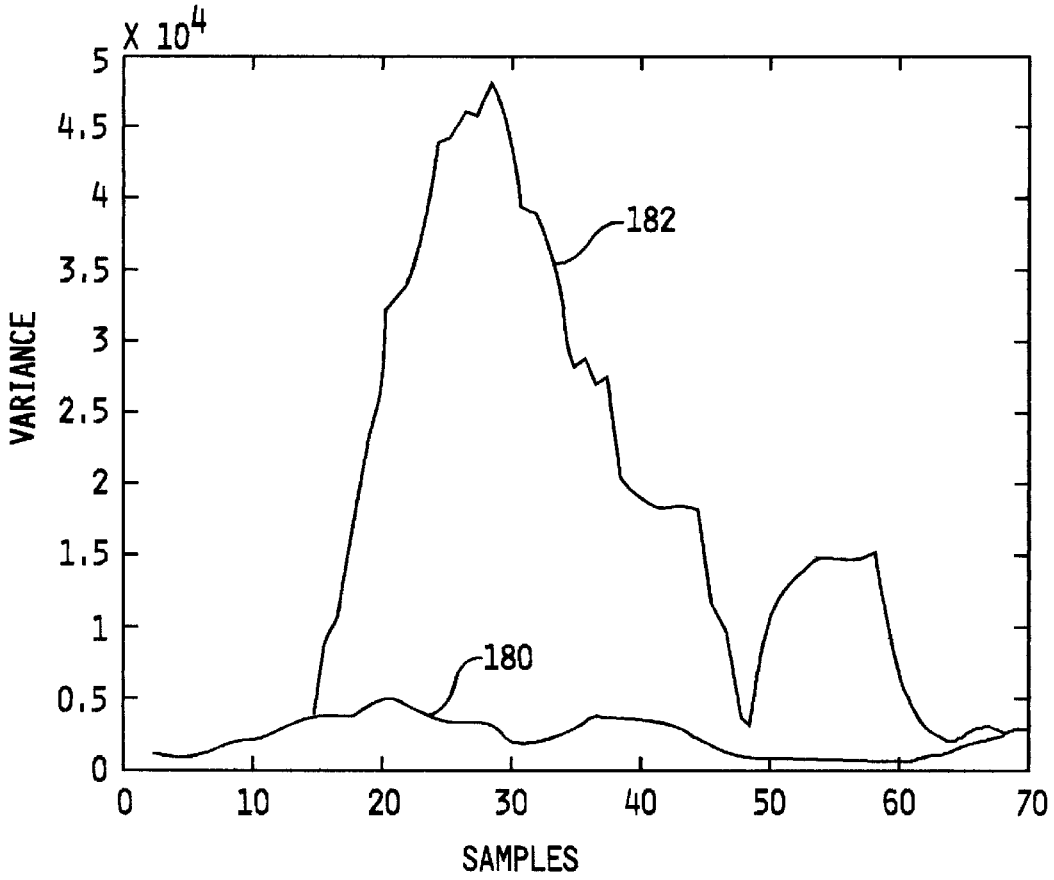
FIG. 11 is a plot of variance vs. number of samples comparing pressure error variance of a normally operating pressure sensor and an erratic pressure sensor, in the fuel system of FIG. 1.
Figure 12:
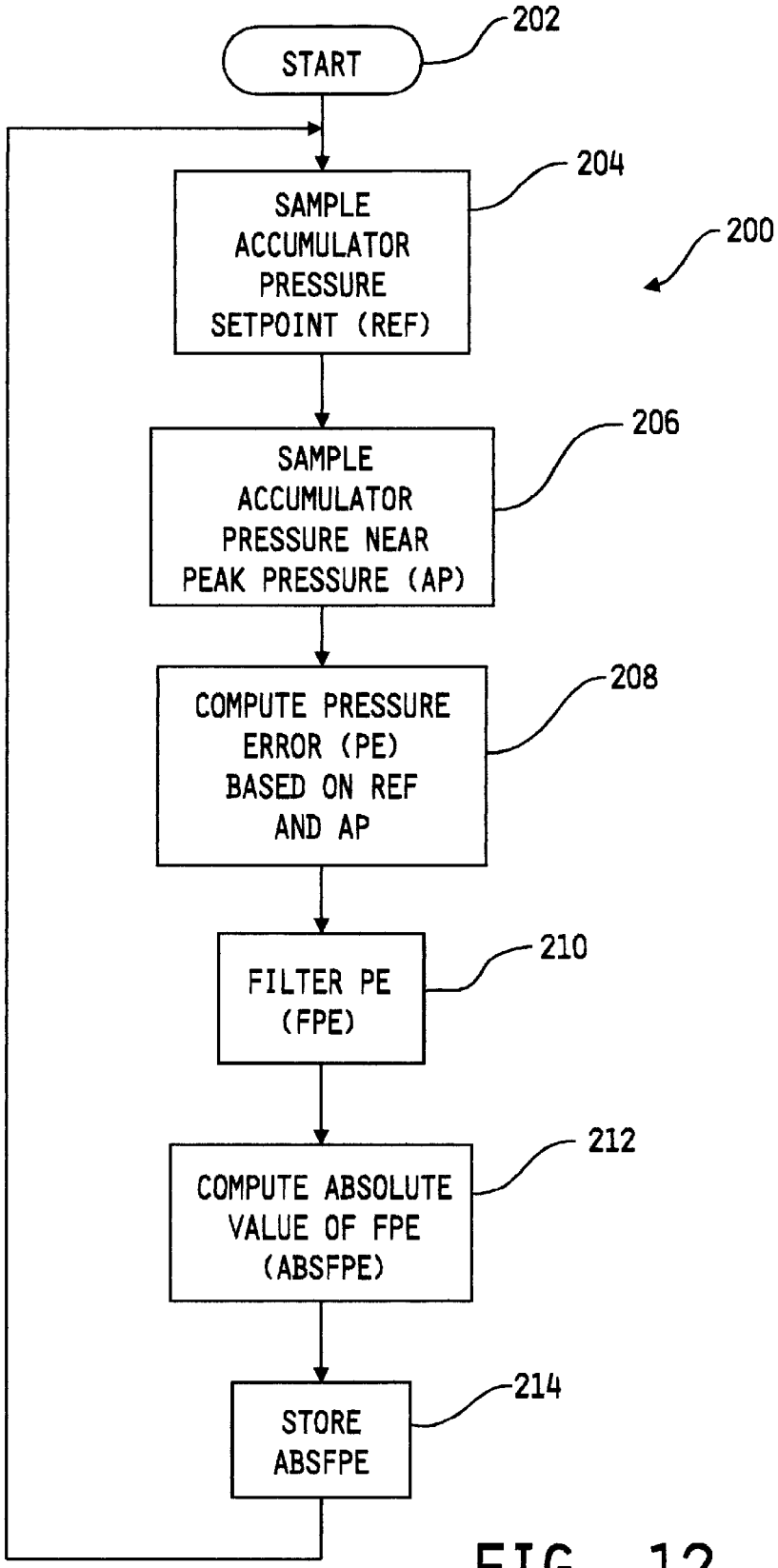
FIG. 12 is a flowchart illustrating one preferred embodiment of a software algorithm for determining processed pressure error values, in accordance with the present invention.
Figure 13:
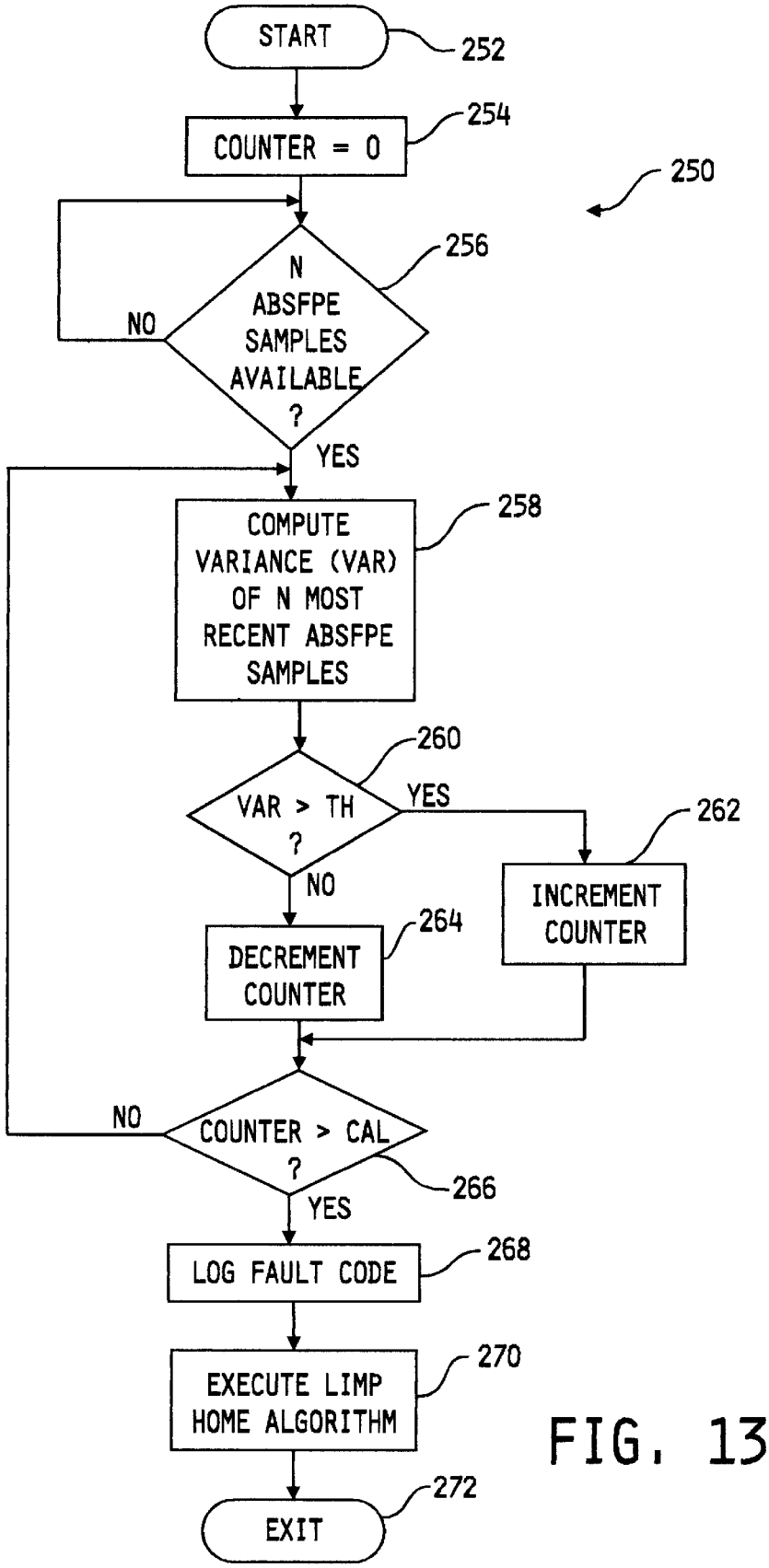
FIG. 13 is a flowchart illustrating one preferred embodiment of a software algorithm for determining a variance of the processed pressure error values determined in accordance with FIG. 12, and for executing diagnostic features upon detection of erratic pressure sensor behavior, in accordance with the present invention.

Referring now to FIGS. 12 and 13, one embodiment of a pair of software algorithms 200 and 250 for diagnosing erratic pressure sensor behavior, in accordance with the present invention, are shown. Algorithms 200 and 250 are preferably included within control computer 58 and are executed thereby many times per second as is known in the art. Preferably, algorithms 200 and 250 are executed simultaneously, and are operable to share information. With the aid of the waveform illustrations of FIGS. 7–11, details of algorithms 200 and 250 will now be described in detail.

Referring to FIG. 12, algorithm 200 begins at step 202 and at step 204, control computer 58 samples the current accumulator pressure setpoint, or reference pressure (REF), preferably provided by the reference pressure calculation block 92 of FIG. 2. Thereafter at step 206, control computer 58 is operable to sample the actual accumulator pressure (AP), preferably via the signal provided on signal path 74 by pressure sensor 72, near the peak pressure value (see FIG. 4) for the present pumping event as described hereinabove. Thereafter at step 208, control computer 58 is operable to compute a pressure error (PE) value based on the current pressure setpoint and current accumulator pressure values. Preferably, control computer 58 is operable to compute the PE value as an algebraic difference between the PE and AP values, although other more complicated difference formulas are contemplated by the present invention.

Algorithm execution continues from step 208 at step 210 where the pressure error value (PE) from step 208 is filtered to remove low frequency components therefrom. Preferably, control computer 58 is operable to provide such filtering in accordance with known software filtering techniques. In one embodiment, control computer 58 includes a high pass software filter having a cut off frequency that is set appropriately so as to remove any constant bias, yet pass the high frequency components indicative of erratic pressure sensor behavior. The remaining filtered pressure error signal (FPE) represents the high frequency components of the measured accumulator pressure signal which do not correspond with the computer commanded pressure setpoint. Thereafter at step 212, control computer 58 is operable to compute an absolute value of the current FPE value determined in step 210, resulting in an absolute valued filtered pressure error value (ABSFPE). Thereafter at step 214, the control computer 58 stores the current ABSFPE value therein for further processing in accordance with the software algorithm 250 of FIG. 13. From step 214, algorithm execution loops back to step 204. Algorithm 200 thus continuously produces a signal indicative of pre-processed (filtered and absolute valued) pressure error values.

Figure 7:
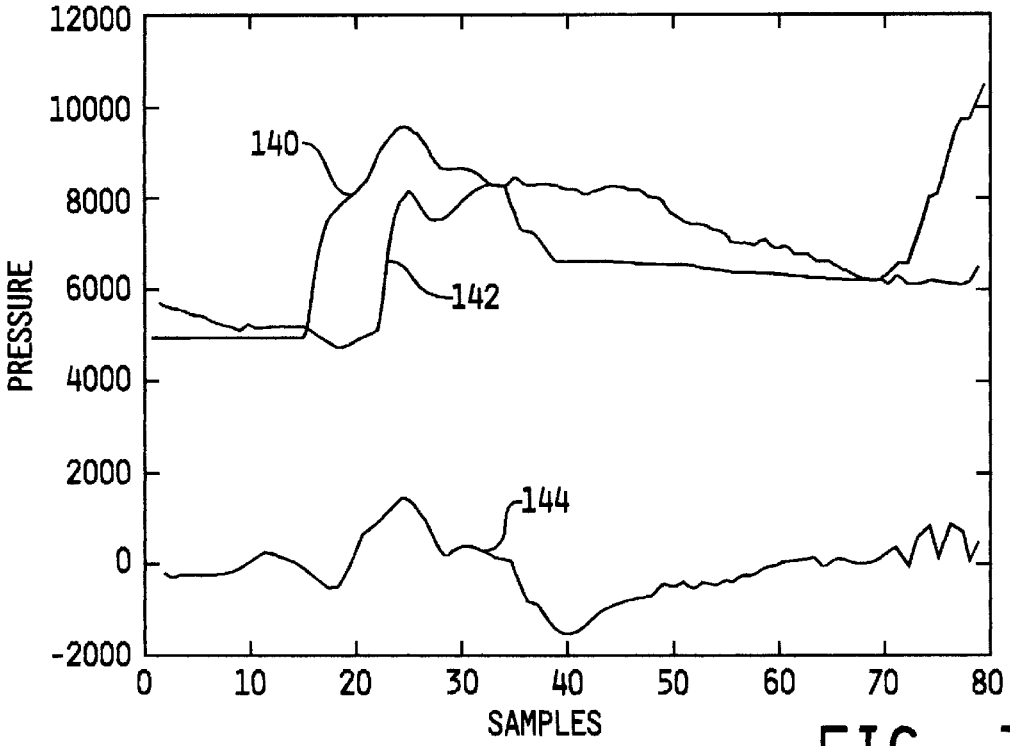
FIG. 7 is a plot of pressure vs. number of samples of target pressure, measured pressure and pressure error waveforms indicative of normal operation of the fuel system of FIG. 1.
Figure 8:
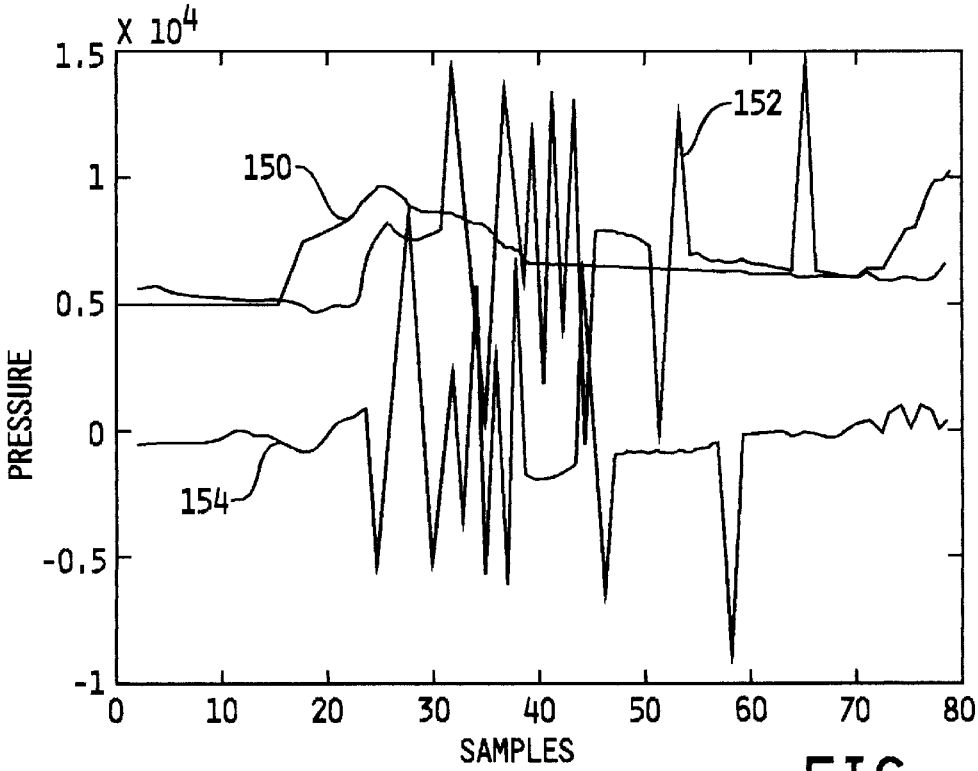
FIG. 8 is a plot of pressure vs. number of samples of target pressure, measured pressure and pressure error waveforms indicative of erratic pressure sensor operation in the fuel system of FIG. 1.

Referring to FIG. 7, example waveforms of the sampled accumulator pressure setpoint values 140 (step 204 of algorithm 200), the sampled accumulator pressure values 142 (step 206 of algorithm 200) and the computed pressure error values 144 (step 208 of algorithm 200) are shown for a normally operating fuel system 10. By contrast, FIG. 8 shows example waveforms of the sampled accumulator pressure setpoint values 150, the sampled accumulator pressure values 152 and the computed pressure error values 154 for a pressure sensor 72 exhibiting erratic sensor behavior.

Referring now to FIG. 13, one embodiment of a software algorithm 250 for processing the stored ABSFPE values (step 214 of FIG. 12), is shown. Algorithm execution begins at step 252 and at step 254 control computer 58 sets a counter equal to an arbitrary value; zero in this case. Thereafter at step 256, control computer 58 determines whether a predefined number, N, of ABSFPE values are available for processing. In one embodiment, control computer 58 includes a queue which holds the ten most recent ABSFPE values, and computer 58 is operable to determine the variance of the pressure error values based on these 10 ABSFPE values. It is to be understood, however, that any number of recent ABSFPE values can be used for the variance computation, and the actual number used is a matter of design choice. In any case, if control computer 58 determines at step 256 that less than N (e.g. 10) ABSFPE samples are available, algorithm execution loops back on step 256 until algorithm 200 provides N such values. When at least N ABSFPE values are available, algorithm execution continues a step 258.

At step 258, control computer 58 computes a variance (VAR) of the N most recent ABSFPE samples. In one embodiment, control computer 58 is operable at step 258 to compute VAR as a simplified variance by summing the N samples. However, the present invention contemplates computing VAR in accordance with other known variance equations at step 258. By computing a simplified variance based on the 10 most recent ABSFPE samples, susceptibility to spurious noise is reduced; i.e. detection of erratic sensor behavior will require detection of a meaningful number of high frequency spikes.

Algorithm execution continues from step 258 at step 260 where control computer 58 tests the variance value VAR against a variance threshold TH, which is preferably calibratable. If, at step 260, control computer 58 determines that VAR is greater than TH, algorithm execution continues at step 262 where control computer 58 increments the error counter. If, at step 260, control computer 58 determines that VAR is less than or equal to the threshold TH, algorithm execution continues at step 264 where the control computer 58 decrements the error counter (preferably not below zero, however). From either of steps 260 or 264, algorithm execution continues at step 266.

At step 266, control computer 58 compares the error counter against a predefined (preferably calibratable) count value. If the error counter is less than the predefined count value, algorithm execution loops back to step 258 for calculation of another variance value. If, at step 266, control computer 58 determines that the error counter is greater than or equal to the predefined count value, algorithm execution continues at step 268 where control computer 58 logs a fault code therein indicative of an erratic pressure sensor failure. In one embodiment, the predefined count value is set at 36 counts, although the present invention contemplates utilizing other count values. Algorithm execution continues from step 268 at step 270 where control computer 58 is operable to execute a limp home fueling algorithm. Preferably, the limp home algorithm is directed to providing at least minimum fueling to sustain engine operation so that the vehicle may be driven out of danger and/or to a service/repair facility. One example of such a limp home algorithm is detailed in pending U.S. patent application Ser. No. 09/033,338, filed by Olson et al., entitled APPARATUS FOR CONTROLLING A FUEL SYSTEM OF AN INTERNAL COMBUSTION ENGINE and assigned to the assignee of the present invention, the contents of which have been incorporated herein by reference. Algorithm execution continues from step 270 at step 272 where algorithm execution is returned to its calling routine. Alternatively, step 270 may loop back to step 254 for continuous execution of algorithm 250.

Figure 9:
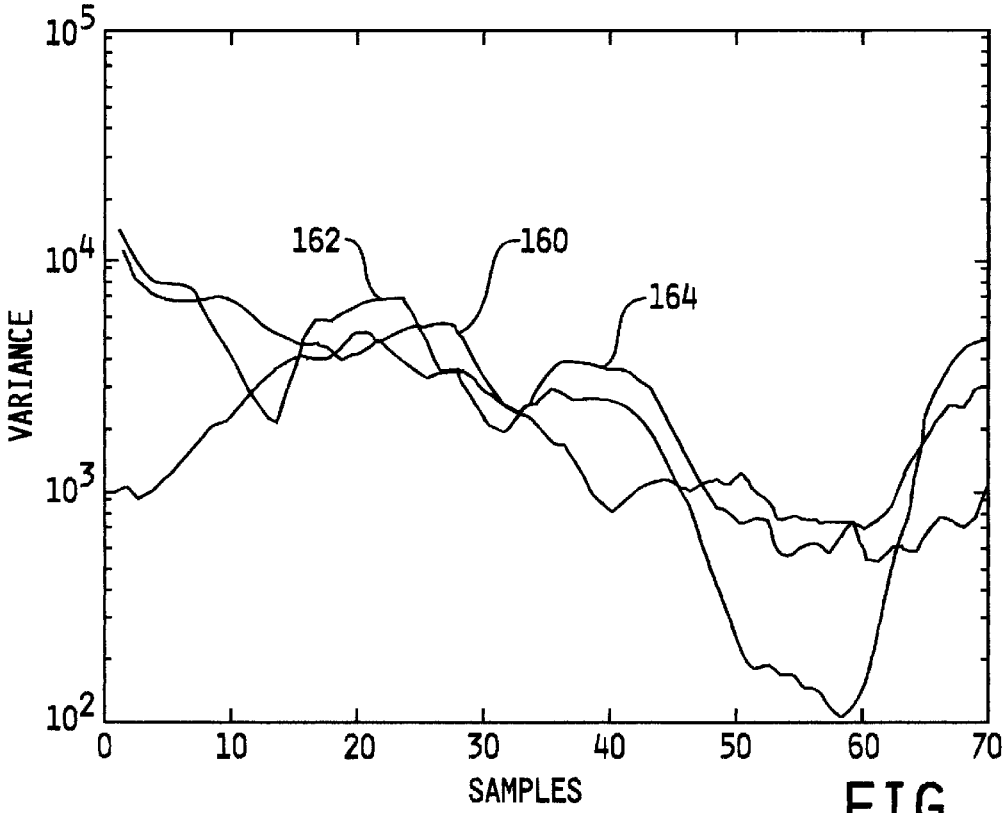
FIG. 9 is a plot of variance vs. number of samples of target pressure variance, measured pressure variance and pressure error variance waveforms indicative of normal operation of the fuel system of FIG. 1.
Figure 10:
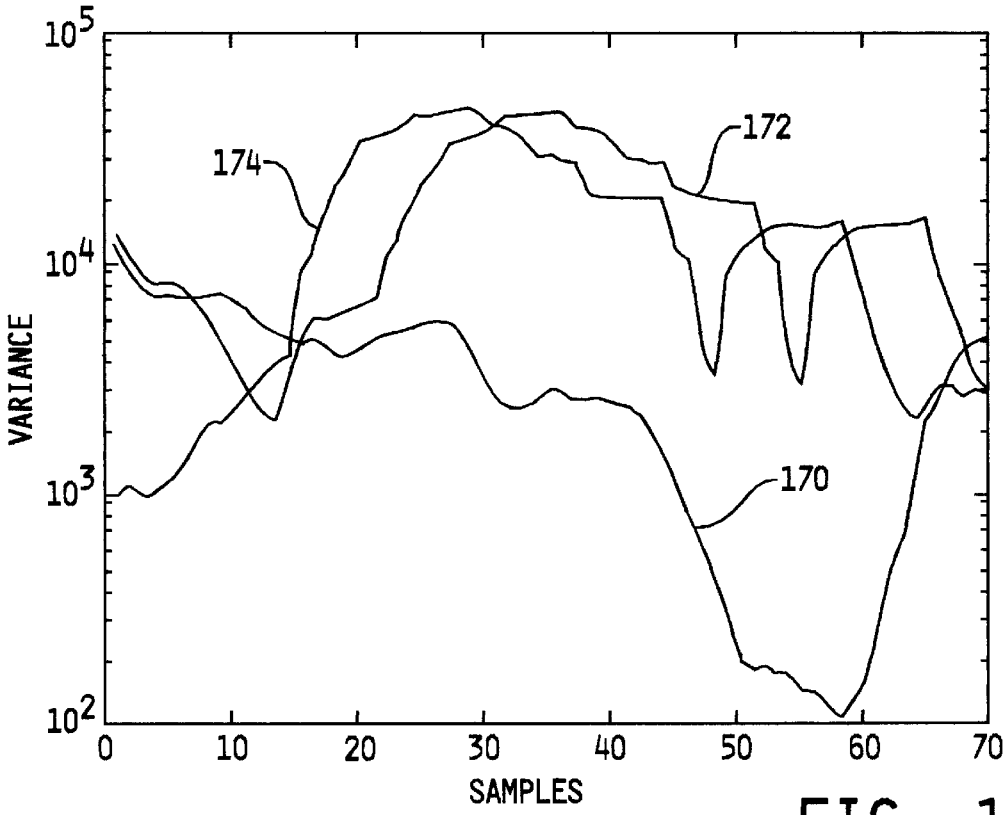
FIG. 10 is a plot of variance vs. number of samples of target pressure variance, measured pressure variance and pressure error variance waveforms indicative of erratic pressure sensor operation of the fuel system of FIG. 1.

Referring to FIG. 9, example waveforms of the variance in the sampled reference pressure values 160, the variance in the sampled accumulator pressure values 162 and the variance in the computed pressure error values 164 are shown for a normally operating fuel system 10. By contrast, FIG. 10 shows example waveforms of the variance in the sampled reference pressure values 170, the variance in the sampled accumulator pressure values 172 and the variance in the computed pressure error values 174 for a pressure sensor 72 exhibiting erratic sensor behavior. FIG. 11 shows a comparison of the variance in the computed pressure error values for a normally 180 operating fuel system 10 and for a pressure sensor 72 exhibiting erratic sensor behavior 182.

While the invention has been illustrated and described in detail in the foregoing drawings and description, the same is to be considered as illustrative and not restrictive in character, it being understood that only one preferred embodiment thereof has been shown and described and that all changes and modifications that come within the spirit of the invention are desired to be protected.

What is claimed is:

1. Apparatus for diagnosing a fuel system of an internal combustion engine, comprising:

an accumulator receiving pressurized fuel from a source of pressurized fuel;

means for sensing fuel pressure within said accumulator and producing a pressure signal corresponding thereto, said pressure signal having peak values corresponding to peak pressures of fuel supplied thereto by said source of pressurized fuel; and a control computer sampling a number of first pressure values each near a separate one of said peak values and determining a number of pressure error values each between a separate one of said number of first pressure values and a corresponding reference pressure, said control computer determining a variance of at least some of said number of pressure error values and incrementing an error counter if said variance exceeds a variance threshold.

2. The apparatus of claim 1 wherein said control computer is operable to decrement said error counter if said variance is less than said variance threshold.

3. The apparatus of claim 2 wherein said control computer is operable to log a fault code if said error counter exceeds a predefined count value.

4. The apparatus of claim 2 wherein said control computer is operable to execute a limp home fueling algorithm if said error counter exceeds a predefined count value.

5. The apparatus of claim 1 wherein said control computer is operable to filter said number of pressure error values to remove low frequency components therefrom and produce a corresponding number of filtered pressure error values.

6. The apparatus of claim 5 wherein said control computer is operable to compute absolute values of said number of filtered pressure error values and produce a corresponding number of absolute values of said filtered pressure error values, said control computer determining a variance of at least some of said absolute values of said filtered pressure error values.

7. The apparatus of claim 6 wherein said control computer is operable to determine a plurality of variance values each of a subset of most recently computed absolute values of said filtered pressure error values.

8. The apparatus of claim 7 wherein said control computer is operable to decrement said error counter if any of said variance values are less than said variance threshold.

9. The apparatus of claim 8 wherein said control computer is operable to log a fault code if said error counter exceeds a predefined count value.

10. The apparatus of claim 9 wherein said control computer is operable to execute a limp home fueling algorithm if said error counter exceeds said predefined count value.

11. The apparatus of claim 1 wherein said control computer is operable to determine said variance as a sum of a subset of said number of pressure error values.

12. A method of diagnosing a fuel system of an internal combustion engine, comprising the steps of:

supplying fuel from a source of pressurized fuel to an accumulator based on a target fuel pressure value;

measuring a number of peak pressure values within said accumulator each near corresponding actual peak pressures therein resulting from said supplying step;

determining a number of error pressure values each between a separate one of said peak pressure values and said target fuel pressure value;

determining a variance of at least some of said number of error pressure values; and incrementing an error counter if said variance exceeds a variance threshold.

13. The method of claim 12 further including the step of decrementing said error counter if said variance is less than said variance threshold.

14. The method of claim 13 further including the step of logging a fault code of said error counter exceeds a predefined count value.

15. The method of claim 14 further including the step of executing a limp home fueling algorithm if said error counter exceeds said predefined count value.

16. The method of claim 12 further including the step of filtering said number of pressure error values to remove low frequency components therefrom and producing a corresponding number of filtered pressure error values;

and wherein said determining a variance steps includes determining said variance as a variance of at least some of said number of filtered error pressure values.

17. The method of claim 16 further including the step of computing absolute values of said number of filtered pressure error values and producing a corresponding number of absolute valued filtered pressure error values;

and wherein said determining a variance steps includes determining said variance as a variance of at least some of said number of absolute valued filtered error pressure values.

18. The method of claim 17 further including the step of determining a plurality of variance values each of a subset of most recently computed absolute valued filtered pressure error values.

19. The method of claim 18 further including the step of decrementing said error counter if any of said variance values are less than said variance threshold.

20. The method of claim 19 further including the step of logging a fault code if said error counter exceeds a predefined count value.

21. The method of claim 20 further including the step of executing a limp home fueling algorithm if said error counter exceeds said predefined count value.

22. The method of claim 12 where said determining a variance step includes determining said variance as a sum of a subset of said number of pressure error values.

* * * * *